US006006790A

United States Patent [19]

Cooper

[11] Patent Number: 6,006,790

[45] Date of Patent: Dec. 28, 1999

[54] DUST EXTRACTION EQUIPMENT FOR LOOMS

[75] Inventor: Stephen Alan Cooper, Huddersfield, United Kingdom

[73] Assignee: Technical Solutions USA Inc., Greenville, S.C.

[21] Appl. No.: 09/028,736

[22] Filed: Feb. 24, 1998

[30] Foreign Application Priority Data

Mar. 22, 1997 [GB] United Kingdom ..... 9706005

[51] Int. Cl.[6] ..... D03J 1/00

[52] U.S. Cl. ..... 139/1 C; 15/345; 15/347

[58] Field of Search ..... 139/1 C; 15/301, 15/345, 347; 66/168

[56] References Cited

U.S. PATENT DOCUMENTS

| | | | |
|---|---|---|---|
| Re. 20,917 | 11/1938 | Eaddy | 139/1 C |
| 2,582,092 | 1/1952 | Ancet | 139/1 C |
| 2,993,351 | 7/1961 | Wheelock | 139/1 C |
| 3,451,435 | 6/1969 | Riha et al. | 139/1 C |
| 4,678,012 | 7/1987 | Graham et al. . | |
| 4,699,179 | 10/1987 | Graham . | |
| 4,820,317 | 4/1989 | Fahey . | |
| 5,074,337 | 12/1991 | Shaw et al. | 139/1 C |
| 5,373,711 | 12/1994 | Takemoto et al. | 66/168 |

FOREIGN PATENT DOCUMENTS

| | | |
|---|---|---|
| 0 408 376 A1 | 1/1991 | European Pat. Off. . |
| 517 248 | 2/1931 | Germany . |
| 1 710 424 | 9/1971 | Germany . |
| 530 497 | 11/1972 | Switzerland . |
| 0 788 041 | 12/1957 | United Kingdom . |
| 1 099 531 | 1/1968 | United Kingdom . |
| 1 180 303 | 2/1970 | United Kingdom . |
| 1 288 689 | 9/1972 | United Kingdom . |
| 2 027 827 | 2/1980 | United Kingdom . |
| 2 027 828 | 2/1980 | United Kingdom . |

*Primary Examiner*—Andy Falik
*Attorney, Agent, or Firm*—Adams Law Firm, P.A.

[57] ABSTRACT

Dust extraction equipment for looms includes a plurality of suction manifolds disposed adjacent to a dust-generating zone of a loom. Ducting communicates with each of the manifolds, a filter cabinet, and a motorized suction fan for drawing dust-contaminated air from the manifolds by way of the ducting and delivering it to the cabinet.

10 Claims, 2 Drawing Sheets

DUST EXTRACTION EQUIPMENT FOR LOOMS

TECHNICAL FIELD AND BACKGROUND OF INVENTION

This invention relates to equipment for extracting dust (which expression is herein intended to include fibres and lint) from looms, particularly but not exclusively those provided with Jacquard, Dobby or Cam shedding control means.

Large amounts of dust are produced during the weaving of fabrics, especially denim. If this dust is not extracted regularly it clogs the machinery, being particularly detrimental to harness cords and to the very large number of rapidly operating undermotion springs beneath a Jacquard loom. The dust also tends to contaminate the cloth, and to cause unhealthy air pollution in the weaving room. An in-depth study of the primary weaving functions shows that the majority of the dust is generated by the constant rubbing together of the warp threads during the shedding function, which may account for 70 percent of the dust, and by the rapid oscillation of the beater during the beat-up function. Significant dust is also generated by warp stop detection, and by weft insertion.

Dust extraction has usually been effected hitherto by so-called atmospheric cleaning systems entailing blowing accumulated dust from the looms and promptly collecting it by suction. Current atmospheric systems typically comprise an overhead endless track carried by the gantries conventionally disposed above rows of looms, and a unit suspended below and travelling progressively along the track and provided with at least one nozzle for blowing air to disturb the dust and with at least one duct for simultaneously sucking in the dust-laden air and delivering it to a filter cabinet. Because the unit has to travel it is relatively complex and so tends to be unreliable, and it does not extract dust continuously from every loom. Furthermore, the atmospheric system fails to collect some of the dust disturbed by its blowing action. It has also been proposed, in European Patent Specification No. 0 408 376 B, to provide loom cleaning apparatus comprising a transverse duct located below the warp sheet and containing at least one fan generating downward air flow through its permeable upper and lower walls. The duct is inside an endless filter belt having an upper dust collection run traversing the duct upper wall. A collector removes dust from the filter belt upper run, preferably by suction nozzles or a scraper. Alternatively a filter fixed across the duct top is cleaned by a moving scraper. This mechanism requires power-driven travelling parts which make it difficult to incorporate within a loom, and it only collects dust from one zone thereof.

SUMMARY OF THE INVENTION

The object of the present invention is to provide a novel concept of equipment giving simplified yet improved dust extraction.

According to the invention, dust extraction equipment for looms comprises at least one suction manifold disposed adjacent to a dust-generating zone of a loom, ducting means communicating with the or each manifold, a filter cabinet, and a motorized suction fan drawing dust-contaminated air from the or each manifold by way of the ducting means and delivering it to the cabinet.

A plurality of suction manifolds are preferably disposed adjacent to the principal dust-generating zones of the loom.

Preferably, a manifold is disposed below the shed formed in the warp sheet on the loom.

Preferably, also, a manifold is disposed above the beat-up mechanism on the loom.

A manifold may be disposed alongside the shedding mechanism on the loom.

Manifold means may also be disposed adjacent to the weft tensioning devices on the loom.

Preferably, one manifold is disposed below the warp sheet between the warp stop motion mechanism and one side of the shedding mechanism on the loom, and another manifold is disposed above the beat-up mechanism and adjacent to the other side of the shedding mechanism on the loom.

Preferably, also, a further manifold is disposed above the warp sheet and adjacent to said one side of the shedding mechanism on the loom.

Preferably, a lateral extension of at least one of the manifolds comprises a tray disposed below a dust-generating zone and inclined towards the manifold.

Preferably, also, air is supplied to that edge of the tray remote from the manifold under a pressure sufficient merely to fluidize the dust which settles on the tray so as to convey it continuously to the manifold and thus prevent an accumulation of dust on the tray.

Preferably, one cabinet and one fan serve a single loom.

Alternatively, one cabinet and one fan serve a group of looms by way of a main duct communicating with the respective ducting means.

The ducting means preferably comprise ducts each of which communicates with one of the manifolds and incorporates a flow-regulating valve.

BRIEF DESCRIPTION OF THE DRAWINGS

Two embodiments of the invention will now be described, by way of example, with reference to the accompanying diagrammatic drawings, of which.

DESCRIPTION OF THE PREFERRED EMBODIMENT AND BEST MODE

Figure 1:
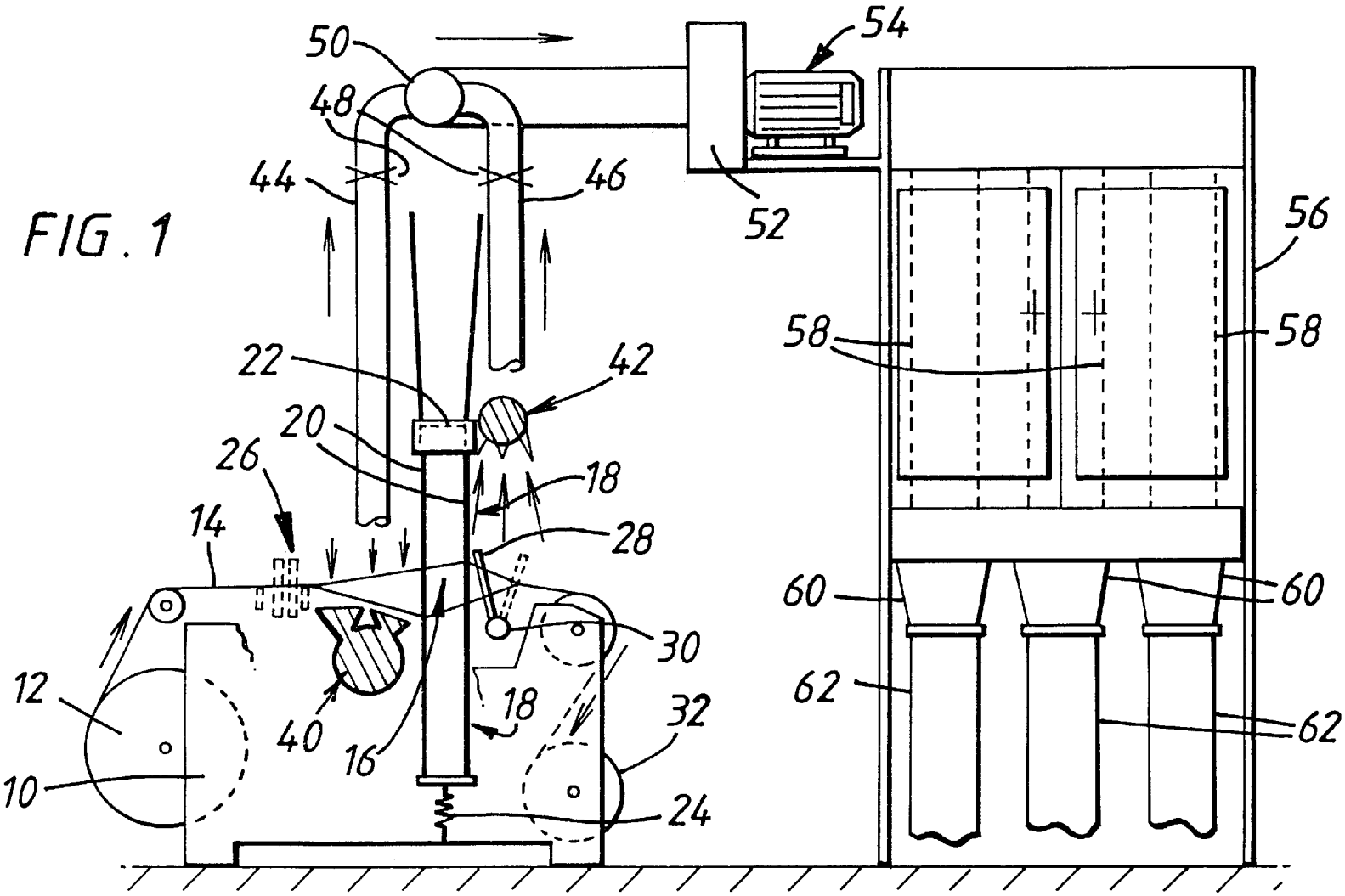
FIG. 1 is a side view of a conventional Jacquard loom provided with dust extraction equipment.

Referring now to FIG. 1 of the drawings, a conventional Jacquard loom comprises a frame 10 on which there is rotateable an elongated warp roller 12 from which a warp sheet 14 comprising a multiplicity of parallel warp threads is drawn to a shedding region 16. A shedding mechanism forms a constantly-varying shed in the warp sheet 14 by the action of a harness indicated generally at 18 and including a multiplicity of harness cords 20 which are activated in well-known manner by Jacquard shedding control means (not shown) and pass through an elongated harness comber board 22 to keep them parallel, and by the co-action of a multiplicity of undermotion springs 24 for keeping the cords 20 taut. The input end of the shed is defined by a known warp stop motion mechanism 26 controlled electronically by means of drop wires, which contact the respective warp threads. The mechanism 26 automatically stops the loom if it detects a broken warp thread. A weft thread (not shown) is reciprocated at high speed through the constantly-varying shed, under the control of known tensioning devices (not shown), in order to form a woven fabric, and after each pass of the weft thread the weave is compacted in known manner by a beat-up mechanism comprising a rapidly oscillating beater assembly 28 carried by an elongated shaft 30. The woven fabric is then wound onto an elongated roller 32.

Dust extraction equipment for this loom comprises one elongated suction manifold 40 disposed adjacent to the shedding region 16 and another elongated suction manifold 42 disposed adjacent to the beater assembly 28. More specifically, the manifold 40 is fixed directly below the warp sheet 14 between the harness 18 and the warp stop motion mechanism 26 at the back of the loom, and the manifold 42 is fixed above the beater assembly 28 and directly alongside the harness comber board 22 at the front of the loom. The manifolds 40 and 42 are connected by ducting means comprising respective flexible subsidiary ducts 44 and 46 leading to a main duct 50 which serves a group of, say four to six, looms arranged side-by-side in a row and is carried by the gantry (not shown) conventionally disposed above said row for the primary purpose of supporting the harnesses 18 and the associated shedding control means of the looms. The subsidiary ducts 44, 46 incorporate respective flow-regulating valves 48 which are set individually at the time that the dust extraction equipment is installed to provide the optimum amount of suction at each of the manifolds 40, 42 in the same group of looms. The main duct 50 communicates with a suction fan 52 driven by a close-coupled electric motor 54, whence the contaminated air passes into a conventional filter cabinet 56 separate from the looms and containing a number of tubular cotton filter bags 58 which extract the dust and feed it into hoppers 60 and ultimately into removeable polythene sacks 62 which can easily be changed when full. The motorized suction fan 52, 54 can be fitted either to the filter cabinet 56 as illustrated or to the gantry, and said fan and said cabinet serve the same group of looms as the main duct 50. It will be noted in this embodiment of dust extraction equipment that there is no blowing to disturb accumulated dust, and that there are no travelling parts to complicate the equipment.

The dust extraction equipment described above is equally well applicable to looms of other types. For example, in a loom with Dobby shedding control means, which is intended to produce relatively plainly woven fabrics compared with the intricately patterned fabrics capable of being woven by a Jacquard loom and thus requires much simpler shed variations, a set of aluminum heddle or heald frames is employed in known manner to form the shed instead of a harness. The suction manifold 40 is then fixed directly below the warp sheet between the heddle frames and the warp stop motion mechanism at the back of the loom, and the suction manifold 42 is fixed above the beater and adjacent to the heddle frames at the front of the loom.

In operation, whatever type of loom is involved, dust is extracted at source immediately it is generated by continuously sucking it through the manifolds 40 and 42, the subsidiary ducts 44 and 46, the main duct 50, and the fan 52 into the filter cabinet 56.

Figure 2:
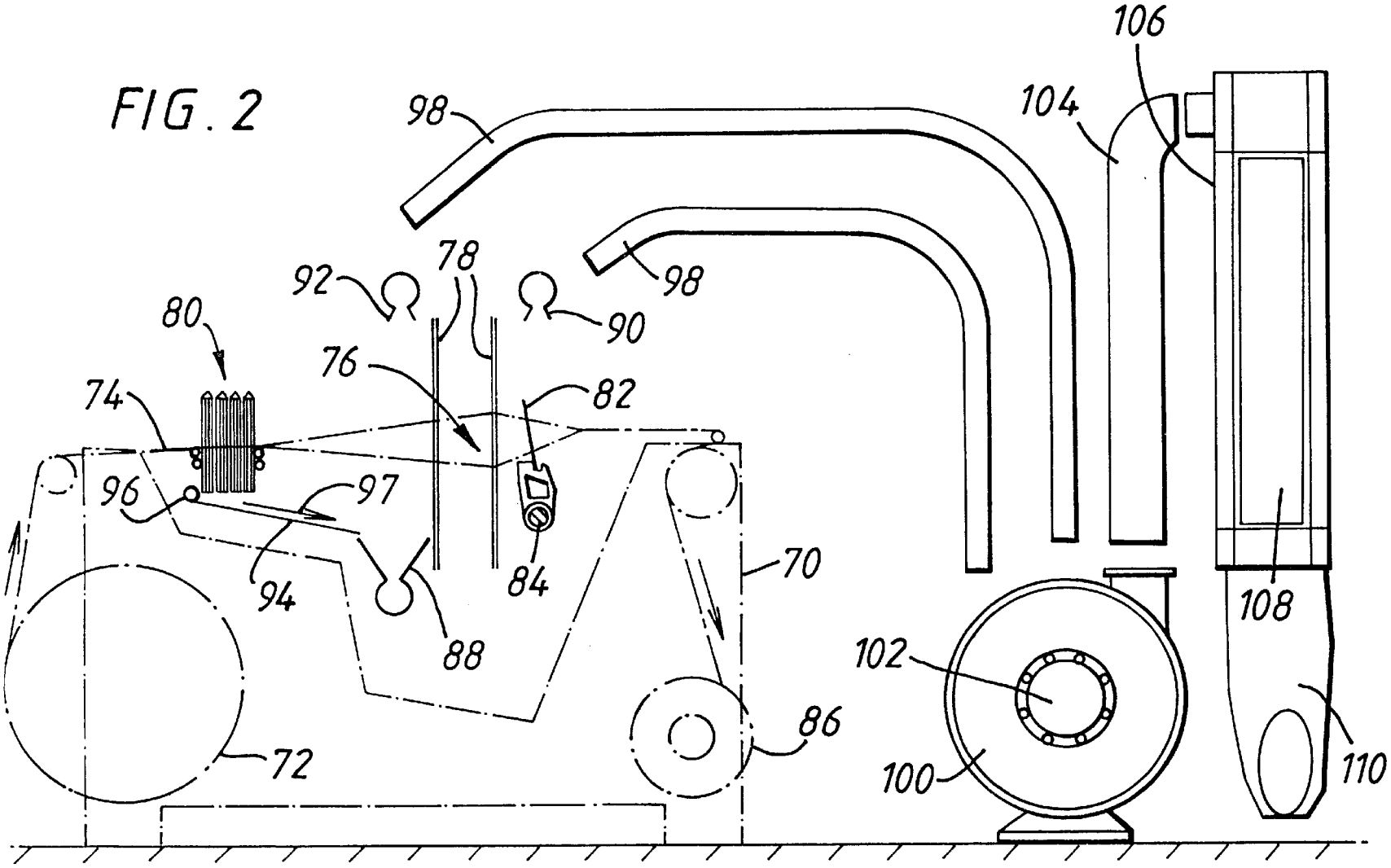
FIG. 2 is a side view of a generalized loom provided with more extensive dust extraction equipment.

Referring now to FIG. 2 of the drawings, a generalized loom, which can be equipped with a Jacquard, Dobby, Cam or other shedding mechanism and can produce flat, terry or pile fabrics, comprises a frame 70 on which there is rotateable an elongated warp roller 72 from which a warp sheet 74 is drawn to a shedding region 76. A shedding mechanism forms a constantly-varying shed in the warp sheet 74 by the action of harness cord or Dobby shaft means indicated generally at 78 which are activated in well-known manner by shedding control means (not shown). The input end of the shed is defined by a known warp stop motion mechanism 80 having drop wires which contact the respective warp threads. A weft thread (not shown) is reciprocated at high speed through the constantly-varying shed, under the control of known tensioning devices (not shown), in order to form a woven fabric, and after each pass of the weft thread the weave is compacted in known manner by a beat-up mechanism comprising a rapidly oscillating beater assembly 82 carried by an elongated shaft 84. The woven fabric is then wound onto an elongated roller 86.

Dust extraction equipment for this loom comprises one elongated suction manifold 88 disposed adjacent to the shedding region 76, another elongated suction manifold 90 disposed adjacent to the beater assembly 82, a further elongated suction manifold 92 disposed alongside the shedding mechanism, and suction manifold means (not shown) optionally disposed adjacent to the weft tensioning devices. More specifically, the manifold 88 is fixed directly below the warp sheet 74 between the means 78 and the warp stop motion mechanism 80 at the back of the loom, the manifold 90 is fixed above the beater assembly 82 and directly alongside the means 78 at the front of the loom, and the manifold 92 is fixed above the warp sheet 74 and directly alongside the means 78 at the back of the loom. The manifold 88 has a lateral extension comprising a tray 94 disposed directly below the warp stop motion mechanism 80 and inclined towards said manifold. A tube 96 having a slot or a multiplicity of apertures (not shown) along its length is fixed to that edge of the tray 94 remote from the manifold 88. Said slot or apertures is or are so orientated parallel to the tray 94, and air is supplied to the tube 96 at such a low pressure, that dust which settles on the tray is merely fluidized but not dispersed so as to be conveyed continuously to the manifold 88 as shown by the arrow 97 thus preventing an accumulation of dust on the tray. The manifolds 88, 90 and 92 and the manifold means which are optionally disposed adjacent to the weft tensioning devices are connected by ducting means comprising respective flexible ducts two of which are indicated at 98 to a floor-mounted suction fan 100 driven by a close-coupled electric motor 102. The contaminated air is passed by the fan 100 through a duct 104 into a conventional filter cabinet 106 separate from the loom and containing at least one cotton filter bag 108 which extracts the dust and feeds it into a disposeable polythene sack 110. In this embodiment the fan 100 and the cabinet 106 serve a single loom. Every subsidiary duct incorporates a flow-regulating valve (not shown) which is set individually at the time that the dust extraction equipment is installed to provide the optimum amount of suction at each of the manifolds 88, 90, 92 and the optional manifold means of the loom. It will be noted in this embodiment of dust extraction equipment that, although air is supplied at a low pressure merely to convey dust which settles on the tray 94 continuously to the manifold 88, there is no blowing for the purpose of actively disturbing accumulated dust, and that there are no travelling parts to complicate the equipment. In operation, dust is extracted at source immediately it is generated.

The concept of dust extraction hereinbefore exemplified has numerous advantages over the prior art. It greatly reduces dust contamination of loom components, and is particularly beneficial in Jacquard weaving by keeping clean the undermotion springs as well as the harness cords both above and below comber board level and thus prolonging their working lives. It also reduces dust contamination of the fabric being produced, and of the air in the weaving room. Having almost no moving parts it is reliable, and has low operational and maintenance costs. It is relatively inexpensive to install, and is easy to retro-fit, that is to say install on existing looms.

I claim:

1. Dust extraction equipment for looms comprising a plurality of suction manifolds adapted to be disposed adjacent to a dust-generating zone of a loom, ducting means communicating with each of said manifolds, a filter cabinet, and a motorized suction fan for drawing dust-contaminated air from said manifolds by way of said ducting means and delivering it to said cabinet, and wherein at least one of said suction manifolds includes a lateral extension defining a tray adapted to be disposed below the dust-generating zone and inclined towards said manifold, and comprising air supply means for supplying air to a far edge of said tray remote from said manifold under a pressure sufficient to entrain dust which settles on said tray and convey it to said manifold, thereby preventing an accumulation of dust on said tray.

2. Dust extraction equipment according to claim 1, wherein one of said plurality of manifolds is adapted for being disposed below a shed formed in a warp sheet on the loom.

3. Dust extraction equipment according to claim 1, wherein one of said plurality of manifolds is adapted for being disposed above a beat-up mechanism on the loom.

4. Dust extraction equipment according to claim 1, wherein one of said plurality of manifolds is adapted for being disposed alongside a shedding mechanism on the loom.

5. Dust extraction equipment according to claim 1, wherein one of said plurality of manifolds is adapted for being disposed adjacent to weft tensioning devices on the loom.

6. Dust extraction equipment according to claim 1, wherein one cabinet and one fan are adapted to serve a single loom.

7. Dust extraction equipment according to claim 1, wherein one cabinet and one fan are adapted to serve a group of looms by way of a main duct communicating with the respective ducting means.

8. In combination with a loom comprising a warp sheet, a warp stop motion mechanism, a shedding mechanism, and a beat-up mechanism, dust extraction equipment comprising a plurality of suction manifolds, wherein at least one of said plurality of manifolds is disposed below the warp sheet between the warp stop motion mechanism and a first side of the shedding mechanism on the loom, and another of said plurality of manifolds is disposed above the beat-up mechanism and adjacent to a second side of the shedding mechanism on the loom.

9. Dust extraction equipment according to claim 8, wherein a further of said plurality of manifolds is disposed above the warp sheet and adjacent to said first side of the shedding mechanism on the loom.

10. Dust extraction equipment for looms comprising a plurality of suction manifolds adapted to be disposed adjacent to a dust-generating zone of a loom, ducting means communicating with each of said manifolds, a filter cabinet, and a motorized suction fan for drawing dust-contaminated air from said manifolds by way of said ducting means and delivering it to said cabinet and wherein said ducting means comprise ducts each of which communicates with one of said plurality of manifolds and incorporates a flow-regulating valve.

* * * * *